US010932338B2

(12) United States Patent
Izumi et al.

(10) Patent No.: US 10,932,338 B2
(45) Date of Patent: Feb. 23, 2021

(54) POWER SUPPLY ADJUSTMENT SYSTEM AND LIGHTING APPARATUS

(71) Applicant: KOITO ELECTRIC INDUSTRIES, LTD., Shizuoka (JP)

(72) Inventors: Takayuki Izumi, Shizuoka (JP); Yukihito Yabuki, Shizuoka (JP); Kazuo Maruyama, Shizuoka (JP)

(73) Assignee: KOITO ELECTRIC INDUSTRIES, LTD., Shizuoka (JP)

( * ) Notice: Subject to any disclaimer, the term of this patent is extended or adjusted under 35 U.S.C. 154(b) by 0 days.

(21) Appl. No.: 16/693,899

(22) Filed: Nov. 25, 2019

(65) Prior Publication Data

US 2020/0178364 A1 Jun. 4, 2020

(30) Foreign Application Priority Data

Nov. 30, 2018 (JP) ..... JP2018-224963

(51) Int. Cl.
*H05B 45/10* (2020.01)

(52) U.S. Cl.
CPC ..... *H05B 45/10* (2020.01)

(58) Field of Classification Search
CPC ..... H05B 45/00; H05B 45/10; H05B 45/20; H05B 47/00; H05B 47/10
See application file for complete search history.

(56) References Cited

U.S. PATENT DOCUMENTS

2010/0045195 A1 2/2010 Yamamuro et al.
2012/0235575 A1* 9/2012 Roberts ..... H05B 45/00 315/151
2013/0249430 A1 9/2013 Oepts et al.
2015/0377695 A1* 12/2015 Chang ..... G01J 3/505 250/208.2
2017/0188420 A1* 6/2017 Kido ..... H05B 45/24

FOREIGN PATENT DOCUMENTS

JP 2005-129403 A 5/2005
JP 2009-529770 A 8/2009
JP 2010-049523 A 3/2010
JP 2017-117811 A 6/2017
WO WO-2007/104146 A1 9/2007

OTHER PUBLICATIONS

Office Action dated Sep. 23, 2020 in Japanese Application No. 2018-224963, along with its English translation.

* cited by examiner

*Primary Examiner* — Jimmy T Vu

(74) *Attorney, Agent, or Firm* — Saliwanchik, Lloyd & Eisenschenk

(57) ABSTRACT

Provided is a power supply adjustment system including: an electronic load whose load voltage is variable; a power supply board that supplies the electronic load with current; and an information processing apparatus that controls the load voltage of the electronic load and the output current of the power supply board to the electronic load on the basis of a current value in the load voltage, in which the information processing apparatus includes a control unit that sets a plurality of load voltages in a predetermined range as the load voltage of the electronic load and sets a correction current value for adjusting the output current to a preset target current value for each of the plurality of load voltages.

7 Claims, 10 Drawing Sheets

POWER SUPPLY ADJUSTMENT SYSTEM AND LIGHTING APPARATUS

CROSS-REFERENCE TO RELATED APPLICATION

This application claims the benefit of Japanese Priority Patent Application No. 2018-224963, filed Nov. 30, 2018, the entire contents of which are incorporated herein by reference.

BACKGROUND

The present invention relates to a power supply adjustment system that adjusts variations in output current due to product errors of a power supply board.

Light emitting diode (LED) lighting is widely employed in various fields of lighting fittings, signal lights, and the like. For example, in a power supply apparatus for railway LED interior lights, variations in output current are caused due to product errors (individual differences between components) of the power supply apparatus (power supply board). Illuminance of the LED interior lights become non-uniform.

In view of this, for example, Japanese Patent Application Laid-open No. 2005-129403 has disclosed a portable terminal apparatus including a standard table for storing in advance standard setting values of the individual colors necessary for providing a predetermined luminous color, means for determining correction coefficients from the setting values of the individual colors when the desired white is obtained by making the LED to emit light and the standard setting values and storing the correction coefficients, and means for determining the setting value for each of the colors by multiplying the correction coefficient to the setting value when the setting value of the desired luminous color is designated, in order to correct variations in amount of light emitted from an LED at the time of incoming call and so on.

SUMMARY

Conventionally, in order to adjust the variations of this output current, a volume resistor provided in the power supply apparatus adjusts a reference voltage of a power supply feed-back and adjusts the output current of the power supply apparatus.

At this time, it is necessary to adjust a volume resistor while viewing an ammeter. Therefore, it is troublesome and time-consuming work. Otherwise, even in a case where current is adjusted at an arbitrary dimming rate (e.g., dimming rate of 100%) and other dimming rates (dimming rate of 0 to 99%) are determined under preset conditions (direct proportion, approximation, and the like), adjustment accuracy is not good. It is thus desirable to increase the adjustment accuracy.

In view of the above-mentioned circumstances, the present invention has been made to provide a power supply adjustment system capable of conveniently and correctly adjusting variations in output current of a power supply board.

In accordance with an embodiment of the present invention, a power supply adjustment system includes an electronic load, a power supply board, and an information processing apparatus.

The electronic load has a variable load voltage.

The power supply board supplies the electronic load with current.

The information processing apparatus controls the load voltage of the electronic load and the output current of the power supply board to the electronic load on the basis of a current value in the load voltage.

The information processing apparatus includes a control unit that sets a plurality of load voltages in a predetermined range as the load voltage of the electronic load and sets a correction current value for adjusting the output current to a preset target current value for each of the plurality of load voltages.

With this configuration, variations in the output current of the power supply board can be conveniently and correctly adjusted.

The power supply board may include a storage medium and a power supply circuit.

The storage medium may store the plurality of correction current values set for each of the plurality of load voltages.

The power supply circuit may be capable of outputting a current value corresponding to one of the stored correction current values.

The control unit may set each of the correction current values for a plurality of predetermined voltages between a maximum voltage and a minimum voltage when the load voltage is set to be a light emitting diode (LED) voltage.

The power supply board may further include a feed-back control unit that controls the power supply circuit such that the output current becomes the target current value on the basis of an instruction of the information processing apparatus.

The feed-back control unit may reduce a proportional gain at a predetermined percentage when a manipulated variable of proportional control (P control) becomes within a predetermined percentage of the target current value.

The predetermined percentage of the target current value may be ±5.0% and the predetermined percentage in the proportional gain may be 65% or more and 75% or less.

The feed-back control unit may fix the manipulated variable to a predetermined value when the output current is within a predetermined percentage from the target current value.

The predetermined value of the manipulated variable may be 1.

In accordance with an embodiment of the present invention, a lighting apparatus includes: a plurality of light emitting diodes (LEDs) for respective RGBW colors; and a power supply board that supplies the plurality of LEDs with current.

The power supply board includes a storage medium that stores an output current value of the power supply board with a dimming rate of each of the respective RGBW colors is associated with the output voltage value.

As described above, in accordance with the present invention, variations in output current of a power supply board can be conveniently and correctly adjusted.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, an embodiment of the present invention will be described with reference to the drawings.

[Schematic System Configuration]

Figure 1:
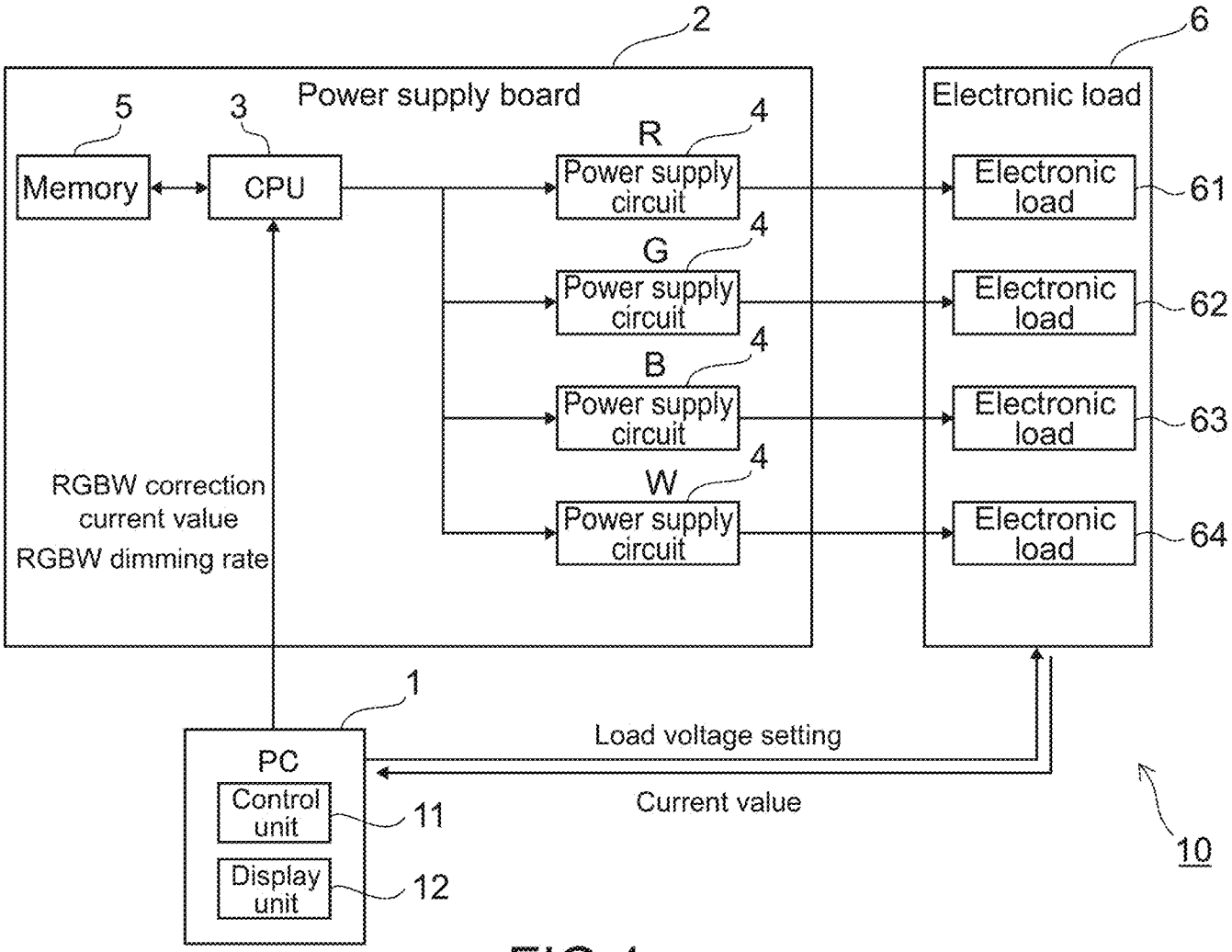
FIG. 1 is a schematic circuit diagram showing a configuration of a power supply adjustment system in an embodiment of the present invention.

FIG. 1 is a schematic circuit diagram showing a configuration of a power supply adjustment system 10 in an embodiment of the present invention. The power supply adjustment system 10 is used at a test stage before shipment of a power supply board 2, for example.

The power supply adjustment system 10 includes a personal computer (PC) 1, the power supply board 2, and electronic loads 6. The PC 1 serves as an information processing apparatus. The electronic loads 6 are load devices whose load voltages are variable in accordance with an instruction from the PC 1. The electronic loads 6 may be configured as parts of a measurement apparatus integral with the PC 1. After the test before shipment is completed, the PC 1 and the electronic loads 6 are detached and only the power supply board 2 is shipped.

The PC 1 includes a control unit 11 and a display unit 12. The control unit 11 comprehensively controls operations of the power supply adjustment system 10. The display unit 12 displays various instruction values supplied to the power supply board 2, output current values of the electronic loads 6, dimming rates, and the like as characters, numerical characters, or figures. The PC 1 further includes a semiconductor memory, a hard disk drive (HDD), and the like capable of storing programs and control parameters for executing operations of the control unit 11, output current values of the electronic loads 6, and the like.

The PC 1 acquires current values supplied to the electronic loads 6 from the power supply board 2. The PC 1 controls the power supply board 2 such that the current values become target current values with respect to an input voltage as will be described later. The control unit 11 sets a plurality of load voltages of the electronic loads 6 in a predetermined range and sets a correction current value for adjusting the output current of the power supply board 2 to the electronic loads 6 to a preset target current value for each of the plurality of load voltages.

The power supply board 2 includes a central processing unit (CPU) 3, four power supply circuits 4 electrically connected thereto, and a memory 5 (storage medium). Here, the number of power supply circuits 4 and the number of electronic loads 6 are equal to the number of colors of red (R), green (G), blue (B), and white (W), that is, four. The number of power supply circuits 4 is not limited thereto and may be an arbitrary number (plural).

The CPU 3 controls the power supply circuits 4. The power supply circuits 4 supply the electronic loads 6 with current on the basis of an instruction of the CPU 3. Each of the power supply circuits 4 includes a rectification device such as a diode and a passive device such as an inductor, a capacitor, and a resistor as well as a switching device such as a field effect transistor (FET), for example. The CPU 3 functions as a feed-back control unit that controls the power supply circuits 4 such that the output current to the electronic loads 6 becomes the above-mentioned target current values on the basis of an instruction of the PC 1.

The memory 5 includes a random access memory (RAM) and a read only memory (ROM). The memory 5 stores a plurality of correction current values set for each of the plurality of load voltages in the electronic loads 6. In this embodiment, the memory 5 stores the output current values of the power supply board 2 in association with dimming rates and output voltage values of the respective RGBW colors.

The electronic loads 6 are each capable of imitating an LED voltage of voltages in a predetermined range (e.g., 20 V or more and 140 V or less) as an arbitrary load voltage. Here, an electronic load 61 corresponds to a red LED, an electronic load 62 corresponds to a green LED, an electronic load 63 corresponds to a blue LED, and the electronic load 64 corresponds to a white LED. The PC 1, the power supply board 2, and the electronic loads 6 are electrically connected to one another in serial communication, for example.

The control unit 11 of the PC 1 sets each of the correction current values for each of a plurality of predetermined voltages between a maximum voltage and a minimum voltage when the load voltages of the electronic loads 6 are set to LED voltages. In this embodiment, the PC 1 sends to the CPU 3 of the power supply board 2 the dimming rates of the respective RGBW colors (dimming signals of 0% or more and 100% or less) with respect to the respective electronic loads 61 to 64 and the correction current values of the respective RGBW colors. As will be described later, the correction current values of the respective RGBW colors are correction target values for adjusting variations in output current described above.

The CPU 3 of the power supply board 2 receives the dimming rates and the correction current values of the respective RGBW colors from the PC 1 and supplies power to the respective electronic loads 61 to 64 at the corresponding current values via the respective power supply circuits 4.

The PC 1 sends the setting values of the load voltages to the respective electronic loads 61 to 64. The power supply adjustment system 10 includes an ammeter that detects a current value in the electronic load 61 to 64 and is capable of outputting the detected current value to the PC 1. The ammeter may be mounted on the electronic load 6 (see FIG. 2), may be mounted on the power supply board 2, or may be mounted to be separate from the electronic load 6 and the power supply board 2.

The power supply adjustment system 10 is configured in the above-mentioned manner. The power supply adjustment system 10 changes the dimming rates and the load voltages of the respective RGBW colors in a range of 0% to 100% and in a range of 20 V to 140 V, respectively. The power supply adjustment system 10 stores the correction current values in all combinations in the memory 5 of the power supply board 2 as a lookup table, for example.

For example, in a case where the power supply board 2 is implemented in a power supply apparatus of an interior light of a railway vehicle, the CPU 3 is capable of reading desired dimming rates of the respective RGBW colors and the correction current values for the load voltages of the corresponding LEDs from the memory 5 and issuing an instruction to supply adjusted current.

[Application Example to Lighting Apparatus]

Figure 2:
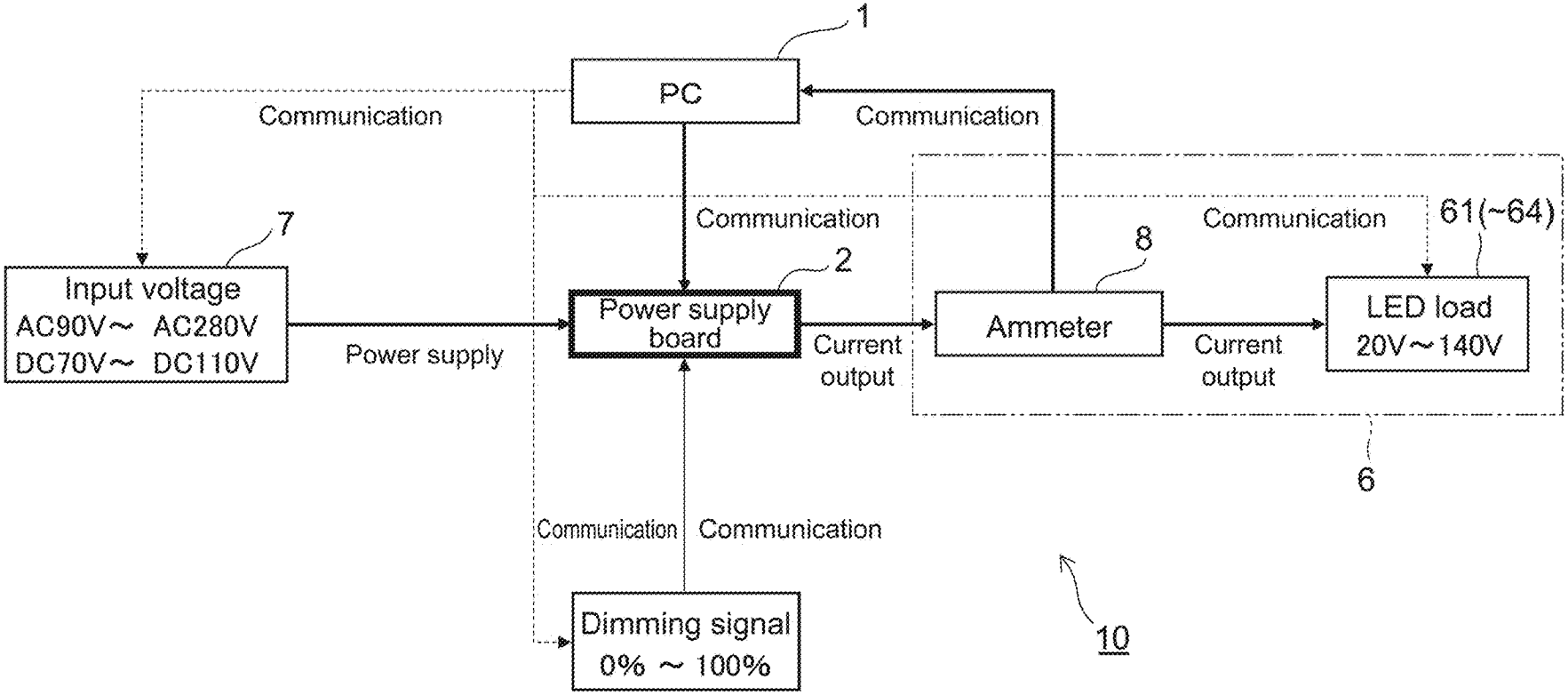
FIG. 2 is a schematic diagram showing a communication configuration of the power supply adjustment system shown in FIG. 1.

FIG. 2 is a schematic diagram showing a communication configuration of the power supply adjustment system 10 shown in FIG. 1.

The power supply adjustment system 10 shown in the figure includes the PC 1, the power supply board 2, the electronic loads 61 to 64, an input power supply (Vin) 7, and an ammeter 8.

The power supply board 2 is electrically connected to the input power supply 7. The input power supply 7 is communicable with the PC 1. An arbitrary voltage (e.g., AC 90 V or more and 280 V or less or DC 70 V or more and 110 V or less) in the predetermined range can be output on the basis of an instruction of the PC 1.

In generation of the above-mentioned lookup table, correction current values in all combinations of the input voltage of that predetermined range, the dimming rates (0% or more and 100% or less) of the respective RGBW colors, and the load voltage in the predetermined range within an operation range are calculated. Therefore, the correction current values with respect to a three-dimensional array of the input voltage, the dimming rates of the respective RGBW colors, and the load voltages are stored in this lookup table.

The ammeter 8 is connected between the power supply board 2 and each of the electronic loads 61 to 64. The ammeter 8 is configured to measure the output current to the electronic load 6 (current flowing through the actual LED load) from the power supply board 2 and output the measured value to the PC 1.

The power supply adjustment system 10 may include other sensors (e.g., a thermal sensor for an FET 11 (see FIGS. 3A and 3B) and an illuminometer for the LEDs) in order to further improve the feed-back element of this type.

As another embodiment, the power supply adjustment system 10 performs real-time control with feed-back by combining the above-mentioned lookup table (test before shipment) or without the lookup table. Alternatively, after the power supply board 2 is implemented on the actual LED loads, the CPU 3 may learn desired dimming rates of the respective RGBW colors and the correction current values for the load voltages of the LEDs by using a kind of neural network.

Figure 3A:
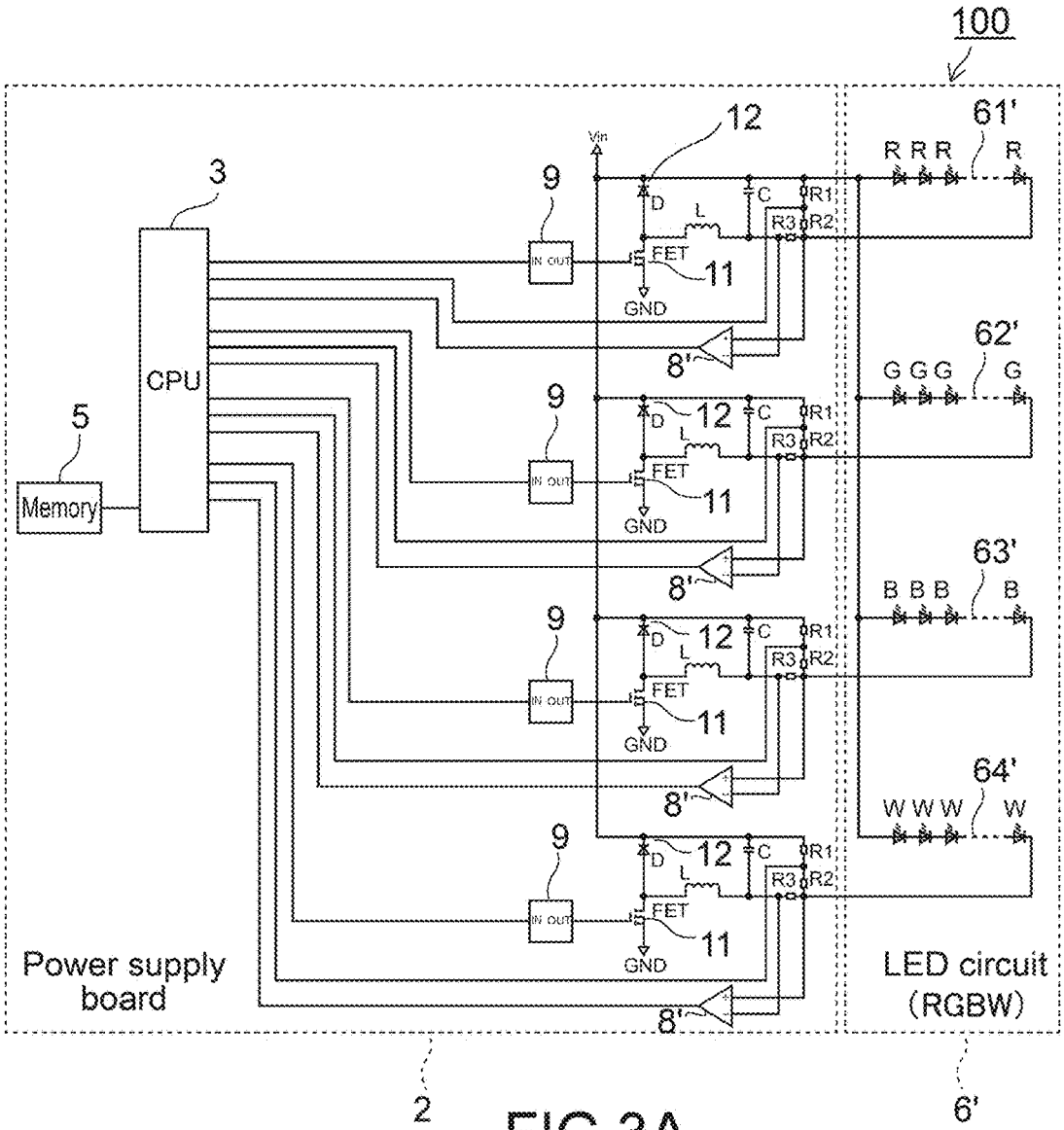
FIG. 3A is a circuit diagram showing an application example to a lighting apparatus of a power supply board adjusted in the power supply adjustment system.
Figure 3B:
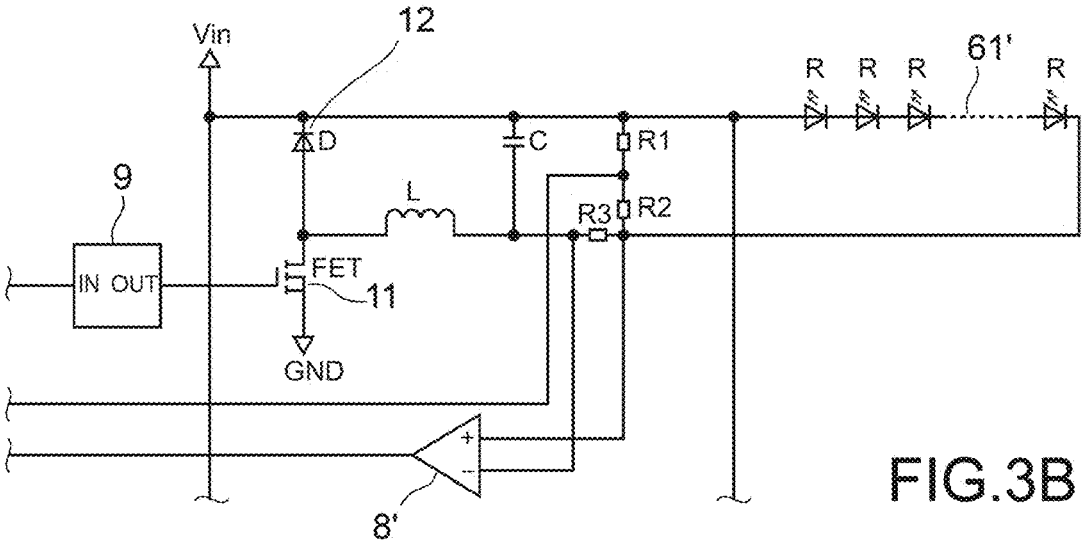
FIG. 3B is an enlarged circuit diagram of a main part of FIG. 3A.

FIG. 3A is a circuit diagram showing a configuration of a lighting apparatus 100 including the power supply board 2 shown in FIG. 1. FIG. 3B is an enlarged circuit diagram of the red (R) section of FIG. 3A.

For example, the power supply board 2 is a part of a DC-DC converter circuit and drives loads such as an LED, a solenoid, and an electric motor. Actual LED loads (the LED circuits of RGBW) 6' are connected to the power supply board 2 instead of the electronic loads 6, such that the PC 1 is not required (the whole of them will be referred to as the lighting apparatus 100).

The power supply board 2 has two modes of an adjustment mode and an operation mode. The power supply board 2 is configured to perform current adjustment on the adjustment mode and shift to the operation mode after the adjustment is completed.

The power supply board 2 includes FET drivers 9, FETs (switching devices) 11, diodes (D, rectification devices) 12, inductors L, capacitors C, current sense amplifiers (ammeters) 8', and a plurality of resistors R1 to R3.

The FET 11 is an N-type MOS FET, though not limited thereto. The N-type MOS FET may be replaced by a Si semiconductor such as a P-type MOS FET, IGBT, and BJT or a switching device such as a compound semiconductor depending on purposes. A rectification device (e.g., FET) that performs similar functions may be used instead of the diode (D) 12.

The FET driver 9 is for shifting the level of a PWM signal output from the CPU 3 to a control voltage for the gate of the FET 11. Electronic loads 61' to 64' are device groups. In the device groups, a plurality of light-emitting diodes of the respective RGBW colors is connected in series for each color.

The CPU 3 is connected to be communicable with the memory 5. The CPU 3 is capable of pulse width modulation (PWM) control based on proportional control (P control). That PWM output terminal is connected to an input (IN) of the FET driver 9. The feed-back control used here is not limited to the P control. Proportional-integral control (PI control) or proportional-integral-differential control (PID control) may be performed depending on purposes.

As shown in FIG. 3B, an output (OUT) of the FET driver 9 is connected to a gate input terminal of the FET 11. A signal ground (GND) is connected to a source of the FET 11.

The CPU 3 controls the FET 11 to periodically switch between an on-state and an off-state to be shown below with a predetermined time duration (duty).

(FET 11 in On-State)

In this state, magnetic energy is stored in the inductor L from the input power supply 7. Here, a capacitor (not shown) may be further disposed for compensating for current when current flowing into the inductor L from the input power supply 7 is below a desired level.

(FET 11 in Off-State)

In this state, the magnetic energy stored in the inductor L transfers to the electronic load 6 and the capacitor C. When the current flowing into the electronic load 6 from the inductor L is the desired level, the capacitor C functions to cause current to flow into the electronic load 6 for compensating for this current.

The CPU 3 periodically switches the time duration (duty) of the on/off-state described above. In this manner, a direct-current voltage A(V) of the input power supply 7 is converted at a different direct-current voltage B(V) and is applied on the electronic load 6.

The ratio of the voltages A(V) to B(V) is determined at the ON/OFF duty ratio. That duty ratio can be adjusted in accordance with the PWM control signal from the CPU 3.

One terminal of the inductor L and an anode of the diode 12 are connected to a drain of the FET 11. The input power supply (Vin) 7 and one terminal of the capacitor C are connected to a cathode of the diode 12. The other terminal of the capacitor C is connected to the other terminal of the inductor L.

That is, a step-down chopper circuit for DC/DC smoothing (DC-DC converter) is configured. Here, the DC-DC converter is not limited to the step-down chopper circuit.

Depending on purposes, the step-down chopper circuit may be replaced by a half-bridge circuit, a full-bridge circuit, or the like.

The electronic load 61' for red (R) and the resistors R1 and R2 connected in series are connected in parallel to the capacitor C. Both terminals of the resistor R3 are each connected to (interposed between) one terminal of the resistor R2 and the other terminals of the inductor L and the capacitor C.

A reverse input (input minus) of the current sense amplifier 8' is connected to the resistor R3, the inductor L, and the capacitor C. A non-reverse input (input plus) of the current sense amplifier 8' is connected to the resistor R2, the resistor R3, and the light-emitting diode R located at the bottom of the electronic load 61'.

In order to feed a voltage (that is, current flowing in the electronic load 61' (corresponding to the current value of FIG. 1)) which is applied on the electronic load 61' back to the CPU 3, a portion between the resistor R1 and the resistor R2 is connected to one AD terminal of the CPU 3 and the output terminal of the current sense amplifier 8' is connected to one AD terminal of the CPU 3.

Descriptions of circuit configurations for the other electronic loads 62' to 64' for green (G), blue (B), and white (W) are omitted because those circuit configurations are similar to the circuit configuration for the electronic load 61' for R.

Here, a plus (upstream) side of each of the electronic loads 61' to 64' is a common potential and a minus (downstream) side is connected to the resistors R2 and R3 and the non-reverse input of the current sense amplifier 8' of each RGBW to be a different potential. With this configuration, wires in the entire power supply circuit 10' can be reduced.

[Current Adjustment of Power Supply Board]

Figure 4:
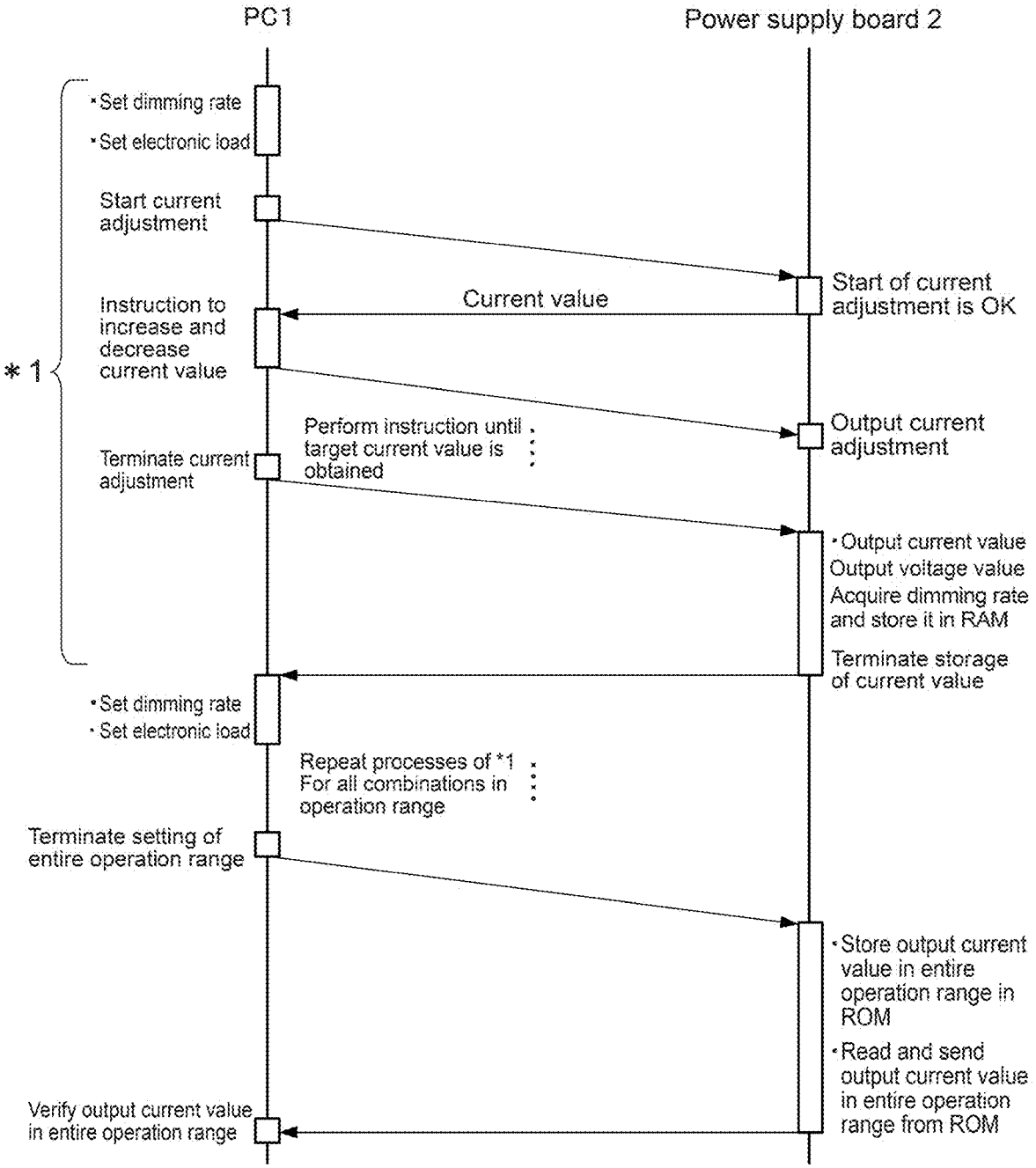
FIG. 4 is a sequence diagram showing a current adjustment function of the power supply board in the power supply adjustment system.

FIG. 4 is a sequence diagram showing a current adjustment function of the PC 1 with respect to the power supply board 2 in the power supply adjustment system 10 shown in FIGS. 1 and 2.

First of all, the dimming rates of the respective RGBW colors and the load voltage in one pattern is individually set at the PC 1 which is a master (e.g., the dimming rate of R is set to 50%, the dimming rates of the other GBW are set to 0%, and the load voltages of all the electronic loads 61 to 64 are set to DC 100 V.)

After that, the PC 1 sends an instruction to start current adjustment to the power supply board 2 which is a slave. Then, the output current (corresponding to manipulated variable (control input) of P control) corresponding to the set one pattern is supplied to each of the electronic loads 6 from the power supply board 2 (current adjustment start is OK), and the ammeter 8 feeds back to the PC 1 a value of current actually flowing into the electronic load 6.

The PC 1 compares the feed-back current value with the target current value (corresponding to default specifications (predetermined initial value) of the power supply circuit 4 at the start). In a case where the feed-back current value is different from the target current value, the PC 1 sends to the power supply board 2 an instruction value for increasing (raising) or decreasing (lowering) current to flow into the electronic load 6 such that the feed-back current value is the target current value.

Based on the output instruction from the PC 1, the CPU 3 of the power supply board 2 causes the output current adjusted by controlling the power supply circuit 4 (controlling the duty ratio of PWM) to flow into the electronic load 6. The series of current adjustment is repeated until a stationary current response in which the output current falls within a predetermined range of the target current value (e.g., within a ±5.0% range of the target current value) is obtained. When the repetition is completed, the PC 1 sends a signal of current adjustment end of the one pattern to the power supply board 2.

Based on an instruction from the PC 1, the power supply board 2 associates the value of the output current (one of the correction current values of the respective RGBW colors) when the stationary current response is obtained or the value of the output current and the output voltage with the dimming rate of the corresponding RGBW color and the load voltage (output voltage value) and stores them in the RAM of the memory 5 (lookup table generation). After that, the power supply board 2 sends a signal of current value storage end to the PC 1.

The series of current adjustment (*1 of FIG. 4) is performed for each predetermined unit (e.g., for each unit of 1.0% and 1.0 V) in all the combinations in the operation range (the dimming rate of each RGBW color and the load voltage are 0% to 100% and 20 V to 140 V, respectively).

Once the current adjustment is performed in the operation range in all the combinations, the power supply board 2 stores the output current value (correction current value) after adjustment in the entire operation range in the ROM from the RAM of the memory 5. With this operation, the output current value in the entire operation range (correction current value of each RGBW color) can be read and sent to the power supply board 2 from the ROM. The output current value in the entire operation range may be directly stored in the ROM not through the RAM or may be monitored in another storage element such as the HDD, the SSD, and the like additionally provided.

After the current adjustment is completed, the PC 1 may read the correction current value once and write only the correction current value corresponding to an instruction value from the PC 1 in the ROM before the PC 1 writes the correction current value in the ROM. With this operation, the reliability of the output current value is enhanced.

Whether the correction current values in the entire operation range can be actually used may be verified. Whether or not the series of current adjustment has been performed may be checked by eyes. For example, in a case where the current adjustment has not been performed, lighting illuminance does not uniformly change when changing the illuminance (e.g., brightness adjustment switch) corresponding to the RGBW dimming rate in some degree (e.g., 30 to 80%). Meanwhile, in a case where the current adjustment has been performed, lighting illuminance uniformly changes. In view of this, whether the current adjustment has been performed may be checked.

Figure 5:
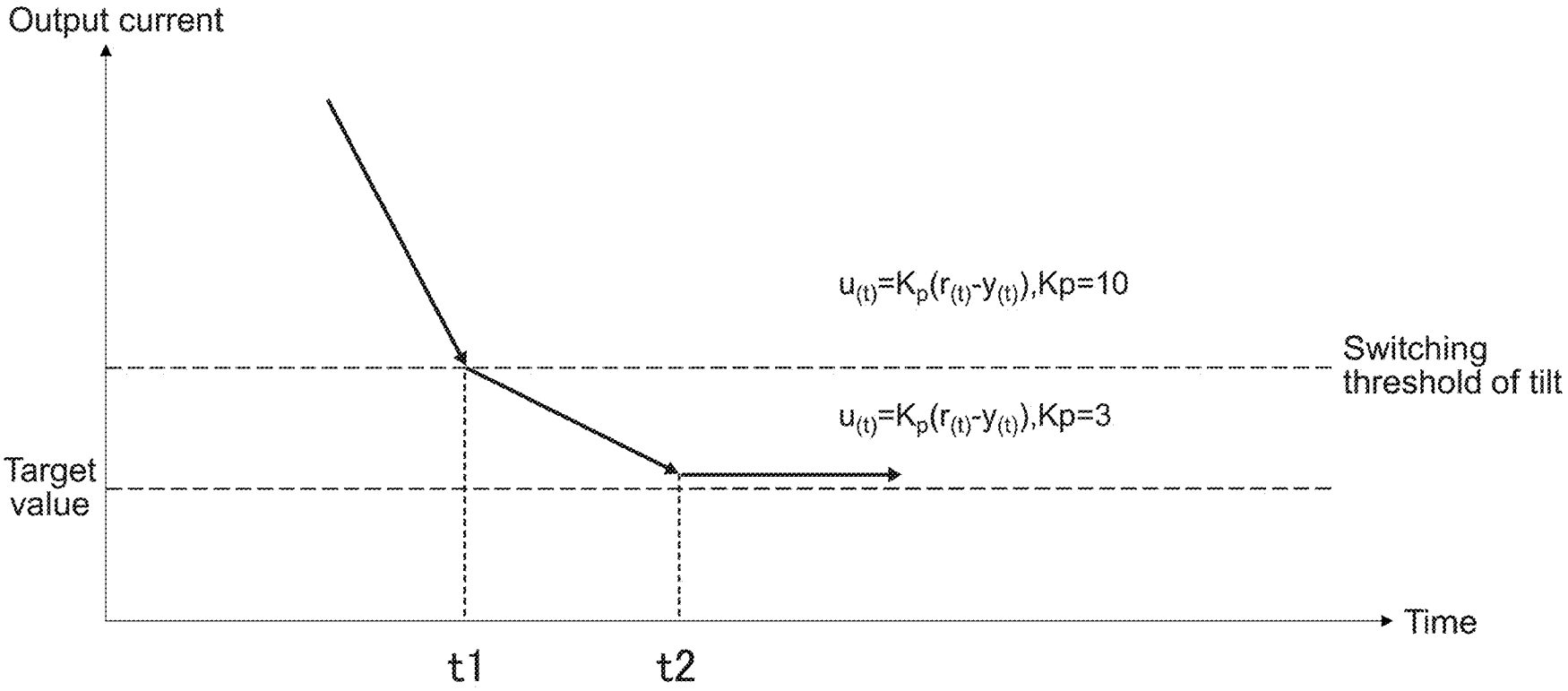
FIG. 5 is a diagram describing an adjustment method for an output current value of the power supply board in the power supply adjustment system.

FIG. 5 is a schematic graph of the P control used for determining the output current value of the power supply board 2 (correction current values of the respective RGBW colors). The horizontal axis indicates the time and the vertical axis indicates the output current.

As shown in the figure, the P control is expressed as the following expression.

$$u_{(t)}=K_p(r_{(t)}-y_{(t)})$$

Where $u_{(t)}$ denotes a manipulated variable (output current value), $K_p$ denotes a proportional gain, $r_{(t)}$ denotes a target current value, and $y_{(t)}$ denotes a current value that actually flowed into the electronic load 6.

In this embodiment, the CPU 3 of the power supply board 2 reduces a proportional gain $K_p$ at a predetermined percentage (value) (e.g., reduction at 70% (7.0) from 10 to 3.0) on the basis of an instruction of the PC 1, so as to suppress a sharp modulation response at the stage at which a manipulated variable $u_{(t)}$ becomes within the predetermined percentage of the target current value (at a time t1) (e.g., when it becomes within ±5.0% of the target current value).

This predetermined percentage is desirably 65% or more and 75% or less for the LED for an interior light of a railway. With this configuration, the responsiveness of the P control can be improved.

Alternatively, the proportional gain $K_p$ may be reduced at the predetermined percentage (e.g., the percentage of 10% or more and 20% or less) at the stage at which a certain control response time elapses (e.g., in each period of 0.010 seconds or more and 0.10 seconds or less).

Figure 6:
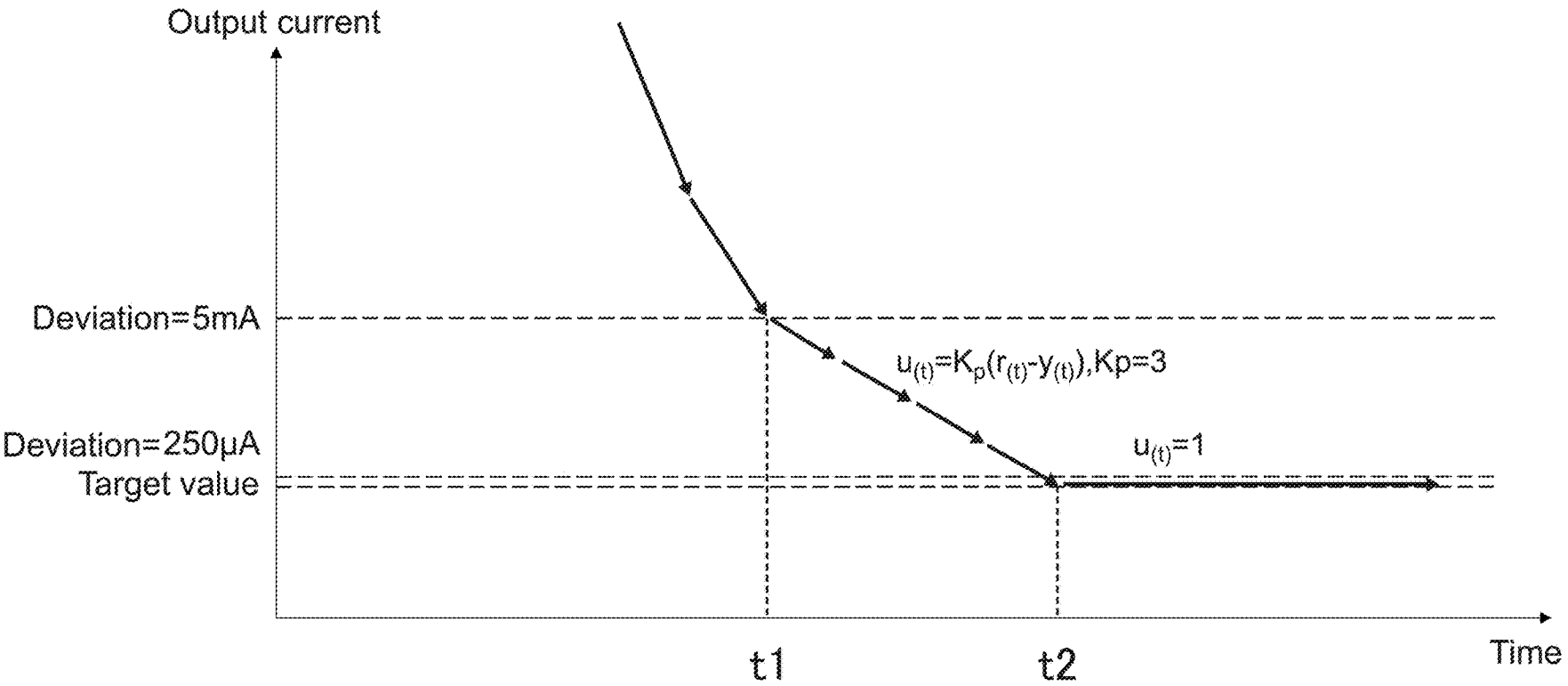
FIG. 6 is a diagram describing the adjustment method for the output current value of the power supply board in the power supply adjustment system.

On the other hand, the manipulated variable $u_{(t)}$ becomes zero and the target value can never be obtained (residual deviation). In order to reduce this residual deviation, the CPU 3 fixes the manipulated variable $u_{(t)}$ to a predetermined value (e.g., 1.0) on the basis of an instruction of the PC 1 (see FIG. 6) when the manipulated variable $u_{(t)}$ becomes within the predetermined value of the target current value (e.g., becomes within ±5.0 mA of the target current value) (at a time t2). Accordingly, the residual deviation is reduced from ±5.0 mA to ±250 μA order and the manipulated variable $u_{(t)}$ converges as one closer to the target current value.

In this embodiment, the P control in two stages from the proportional gain adjustment control to the manipulated variable adjustment control is basically used. In the manipulated variable adjustment control, it is considered that the current adjustment of the set one pattern is completed when the increase/decrease of the manipulated variable $u_{(t)}$ of the P control becomes 0 continuously a predetermined number of times (e.g., five times).

Figure 7:
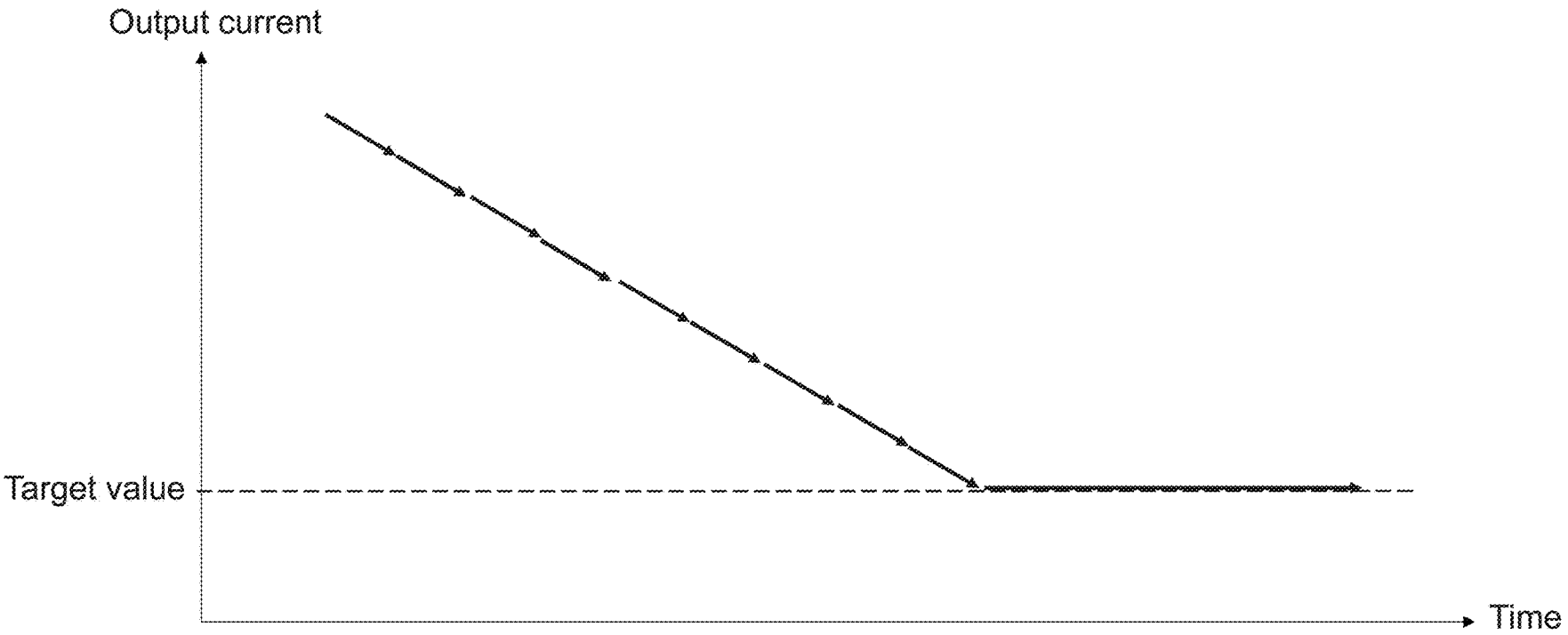
FIG. 7 is a diagram describing the adjustment method for the output current value of the power supply board in the power supply adjustment system.

Alternatively, as shown in FIG. 7, the adjustment frequency (sampling time) on the horizontal axis may be fixed to the minimum value. In this case, it takes more time until the manipulated variable $u_{(t)}$ becomes stable in comparison with the adjustment method shown in FIGS. 5 and 6. However, the manipulated variable $u_{(t)}$ finally converges as one much closer to the target current value.

Figure 8:
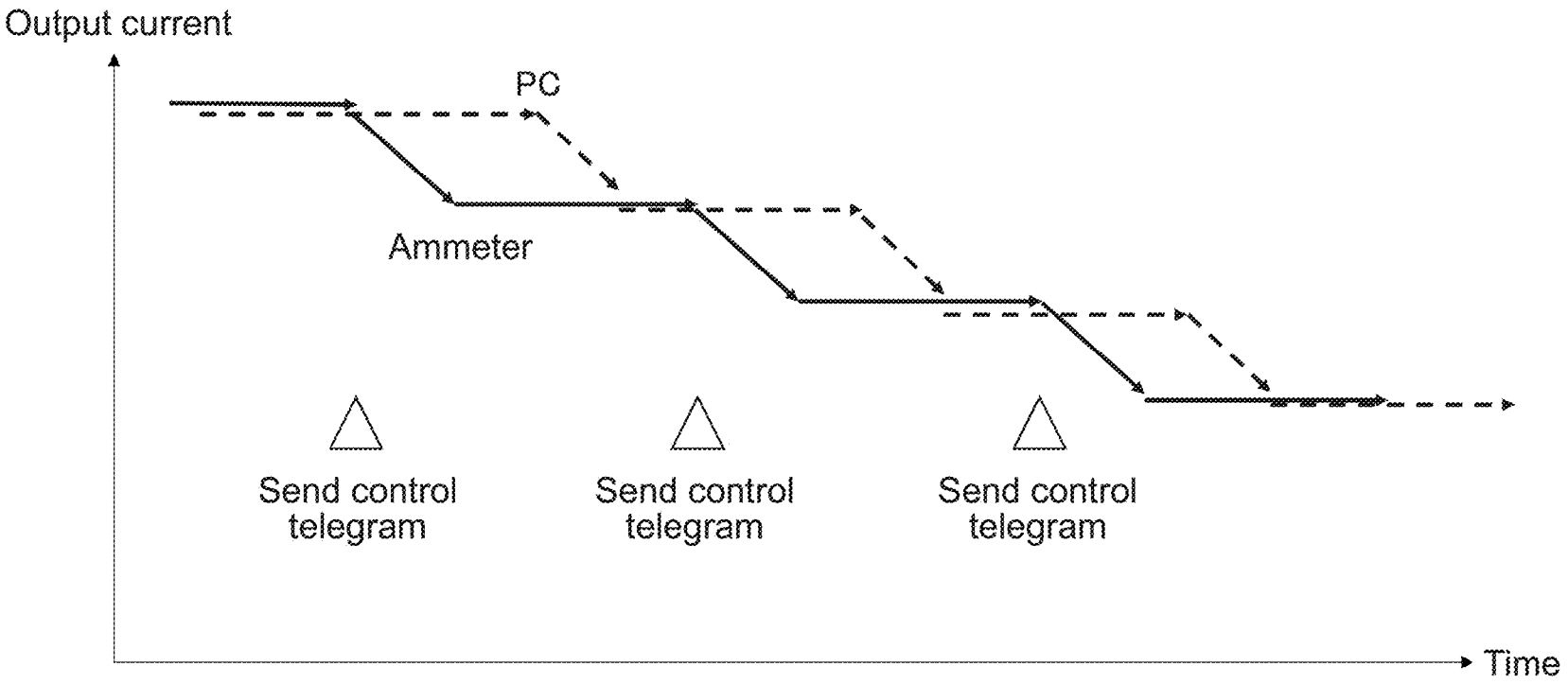
FIG. 8 is a diagram describing the adjustment method for the output current value of the power supply board in the power supply adjustment system.

The basic current adjustment operation is set to be proportional control (P control). Alternatively, the PC 1 may be configured to stand by for sending of a next control telegram (execution of step, see FIG. 8) until the value of the ammeter 8 in a predetermined number of ammeter access cycles (e.g., 10 ms) becomes stable within a final allowable error (e.g., it enters a final allowable error range continuously five times).

With this configuration, influence due to the time difference until the PC 1 recognizes the actual current value is reduced. Therefore, a more accurate feed-back current value is sent back to the PC 1. The responsiveness of the P control can be thus improved. Such control to stand by for sending may be combined with the above-mentioned proportional gain adjustment control and manipulated variable adjustment control.

All the thresholds of the predetermined percentage of the proportional gain $K_p$ and the like, which have been described above, may be adjusted as a configuration file. Further, a case where an error between the target current value and the output current is (±) 64% or more, a case where the error between the target current value and the output current is 16% or more and is below 64%, a case where the error between the target current value and the output current is below 16% may be displayed on a monitor (not shown) of the PC 1 in color (e.g., red→yellow→green) of the progress bar as an error level.

The response speed and measurement accuracy of the ammeter 8 varies depending on a maker, a model, and the like. Therefore, the ammeter access cycle, the instruction sending cycle (see FIG. 9), and the final allowable error may also be adjustable as a configuration file.

By adding such a configuration file to the prescribed folders on the PC 1 and re-activating (executing) the application, selectable configuration sets may be automatically increased (displayed).

Figure 9:
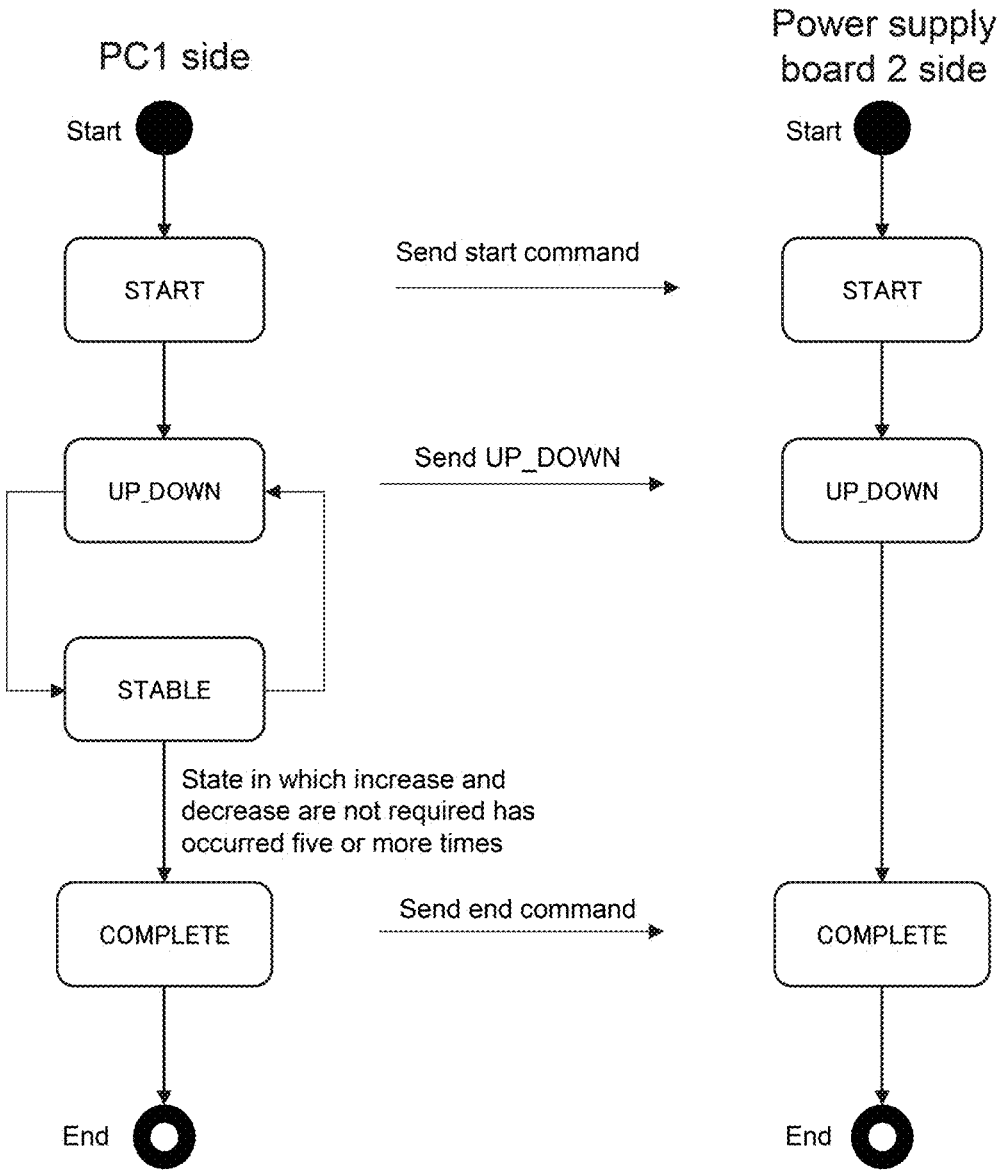
FIG. 9 is a state transition diagram of an output current value during automatic current adjustment.

FIG. 9 is a state transition diagram of the output current value during automatic current adjustment.

For the current adjustment, four states of UP (increase), DOWN (decrease), STABLE (keep), and COMPLETE (complete adjustment) are defined in the output current value ($u_{(t)}$, the manipulated variable).

The PC 1 and the power supply board 2 are activated (start). First of all, the PC 1 sends a start instruction to the power supply board 2 and automatic current adjustment is started (START).

After that, on the basis of the feed-back current value, the PC 1 determines whether the output current value, any one of UP, DOWN, or STABLE should be executed.

In a case where the PC 1 determines that UP or DOWN should be executed, an UP instruction or a DOWN instruction is sent to the power supply board 2. This determination is repeated until STABLE is determined a predetermined number of times (e.g., five times).

The processing depending on each state is executed in a predetermined cycle. The output current value when UP or DOWN instruction is sent fluctuates under the above-mentioned conditions (FIGS. 5 to 8). When output current value approaches the target value, a variation amount is made smaller. The variation amount is determined on the basis of the gain $K_p$ of the P control. Although the PI, PD, and PID are not basically used, those may be used in a manner that depends on needs.

When STABLE is determined a predetermined number of times, COMPLETE is obtained. Then, the PC 1 sends an end instruction to the power supply board 2 and automatic current adjustment is completed (ends).

Here, STABLE means that the output current value falls within a range of a maximum allowable error (order of the residual deviation) in a single sampling time (in other words, the output current value has converged).

Figure 10:
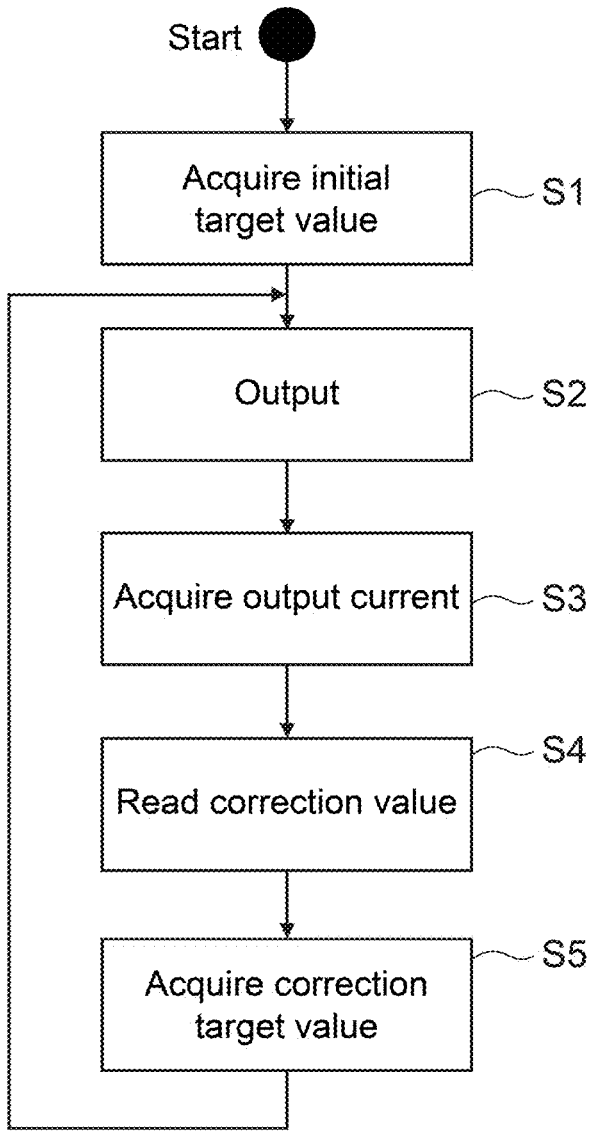
FIG. 10 is a flowchart describing operations during operation of the power supply board.

FIG. 10 is a flowchart during operation of the power supply board 2.

First of all, an initial target value (corresponding to default specifications of the power supply circuits 4) is acquired as a target value (Step S1). At the start, the LED forward voltage is unknown. Therefore, output is performed with this initial target value (Step S2).

After that, the ammeter 8 acquires output current (output voltage) (Step S3).

After the output current is acquired, one of the correction current values of the respective RGBW colors, which corresponds to this output current and the initial target value are read from the above-mentioned lookup table (Step S4). After that, the target value is updated from the initial target value to the "initial target value+the correction current value" (Step S5) as the correction target value and the updated target value is acquired. Then, the current is output.

By repeating Steps S2 to S5, variations in the output current in the power supply board can be conveniently and correctly adjusted. The illuminance of the LEDs (interior lights) assembled in the power supply board 2 can be thus made uniform.

In accordance with this embodiment, adjustment of variations in the output current of the power supply apparatus (power supply board) connected to the voltage LEDs (interior lights) in the predetermined range is made automatic and the man-hour is reduced. In addition, the accuracy of output current for (desired) dimming rate can be enhanced in all the combinations of the dimming rates and the output current.

The power supply adjustment system according to this embodiment can be widely applied not only to the LED but also to all motors, solenoids, and sensing devices as electronic loads.

The control method for the electric power conversion apparatus according to each of the above-mentioned embodiments is not limited to pulse width modulation (PWM). Other control methods such as pulse amplitude modulation (PAM) and pulse frequency modulation (PFM) can also be applied therefor.

It should be understood by those skilled in the art that various modifications, combinations, sub-combinations and alterations may occur depending on design requirements and other factors insofar as they are within the scope of the appended claims or the equivalents thereof.

What is claimed is:

1. A power supply adjustment system, comprising:

an electronic load whose load voltage is variable;

a power supply board that supplies the electronic load with current; and an information processing apparatus that controls the load voltage of the electronic load and the output current of the power supply board to the electronic load on the basis of a current value in the load voltage, wherein the information processing apparatus includes a control unit that sets a plurality of load voltages in a predetermined range as the load voltage of the electronic load and sets a correction current value for adjusting the output current to a preset target current value for each of the plurality of load voltages, and wherein the power supply board includes a storage medium that stores the plurality of correction current values set for each of the plurality of load voltages, and a power supply circuit capable of supplying the electronic load with current corresponding to one of the stored correction current values.

2. The power supply adjustment system according to claim 1, wherein the control unit sets each of the correction current values for a plurality of predetermined voltages between a maximum voltage and a minimum voltage when the load voltage is set to be a light emitting diode (LED) voltage.

3. The power supply adjustment system according to claim 1, wherein the power supply board further includes a feed-back control unit that controls the power supply circuit such that the output current becomes the target current value on the basis of an instruction of the information processing apparatus.

4. The power supply adjustment system according to claim 3, wherein the feed-back control unit reduces a proportional gain at a predetermined percentage when a manipulated variable of proportional control (P control) becomes within a predetermined percentage of the target current value.

5. The power supply adjustment system according to claim 4, wherein the predetermined percentage of the target current value is ±5.0%, and the predetermined percentage in the proportional gain is 65% or more and 75% or less.

6. The power supply adjustment system according to claim 4, wherein the feed-back control unit fixes the manipulated variable to a predetermined value when the output current is within a predetermined percentage from the target current value.

7. The power supply adjustment system according to claim 6, wherein the predetermined value of the manipulated variable is 1.

* * * * *